US007162990B1

(12) United States Patent
Ioja et al.

(10) Patent No.: US 7,162,990 B1
(45) Date of Patent: Jan. 16, 2007

(54) TWO-PART PISTON FOR AN INTERNAL COMBUSTION ENGINE

(75) Inventors: Valerian Ioja, Windsor (CA); Michael T. Lapp, Bloomfield, MI (US)

(73) Assignees: Mahle Technology, Inc., Farmington Hills, MI (US); Mahle International GmbH, Stuttgart (DE)

( * ) Notice: Subject to any disclaimer, the term of this patent is extended or adjusted under 35 U.S.C. 154(b) by 0 days.

(21) Appl. No.: 11/322,189

(22) Filed: Dec. 29, 2005

(51) Int. Cl.
*F02F 3/00* (2006.01)

(52) U.S. Cl. ..... 123/193.6

(58) Field of Classification Search ..... 123/193.6
See application file for complete search history.

(56) References Cited

U.S. PATENT DOCUMENTS

| | | | | |
|---|---|---|---|---|
| 5,052,280 | A * | 10/1991 | Kopf et al. | 92/186 |
| 5,261,363 | A * | 11/1993 | Kemnitz | 123/193.6 |
| 5,357,920 | A * | 10/1994 | Kemnitz et al. | 123/193.6 |
| 5,546,896 | A * | 8/1996 | Zaiser | 123/193.6 |
| 6,920,860 | B1 * | 7/2005 | Gabriel et al. | 123/193.6 |

FOREIGN PATENT DOCUMENTS

| | | | |
|---|---|---|---|
| DE | 4039752 | A1 * | 6/1992 |
| WO | WO 90 04094 | | 4/1990 |
| WO | WO 92 10658 | | 6/1992 |
| WO | WO 92 10659 | | 6/1992 |

* cited by examiner

*Primary Examiner*—Marguerite McMahon
(74) *Attorney, Agent, or Firm*—Collard & Roe, P.C.

(57) ABSTRACT

A two-part piston for an internal combustion engine, comprising a piston head and a piston skirt connected with the piston head in articulated manner, by way of a piston pin. The piston head has a piston crown that is followed by a cylindrical circumference surface having a top land and a ring belt. The piston head can include a ring-shaped circumferential cooling channel disposed within the piston head. The opening of this cooling channel faces the piston skirt, and is closed off with a seal element. There is a seal element that has a first free end that is held between piston head and piston skirt, or rests against an outer wall of the cooling channel. The seal element has a second free end that rests against the piston head, and wherein the seal element has a bottom that lies on a surface of the piston skirt that faces the cooling channel.

21 Claims, 2 Drawing Sheets

TWO-PART PISTON FOR AN INTERNAL COMBUSTION ENGINE

BACKGROUND OF THE INVENTION

The present invention relates to a two-part piston for an internal combustion engine, comprising a piston head and a piston skirt connected with the piston head in articulated manner, by way of a piston pin. The piston head has a piston crown that is followed by a circumferential side wall having a top land and a ring belt. There is a ring-shaped circumferential cooling channel that is disposed within the piston head, the opening of which, facing the piston skirt, is closed off with a seal element.

Pistons of this type are known from WO 92/10658 A1 and from WO 92/10659 A1. A comparable piston is furthermore known from WO 90/04094 A1.

The pistons described in these references have the common feature that the piston head and the piston skirt are connected with one another only by way of a piston pin. For this purpose, both the piston head and the piston skirt have pin bosses that have pin bores that align in the assembled state, by means of which the piston pin is guided. This type of piston, in which the piston head and the piston skirt are connected with one another in articulated manner by means of the piston pin, are also called articulated pistons. They have the advantage that the piston head, which is subject to greater stress due to the temperatures and pressures that prevail in the adjacent combustion chamber, can be produced from a different material than the piston skirt, which is at a greater distance from the combustion chamber and subject to less stress. The piston head can be produced from steel, for example, and the piston skirt from an aluminum material. This is supposed to counteract damage, for example cracks and fractures at the piston head. With these articulated pistons, the piston head has to be effectively cooled because of its great thermal stress. For this purpose, there is a circumferential cooling channel for a coolant within the piston head, approximately at the height of the top land and the ring belt.

The problem with articulated pistons is that this cooling channel is not tightly sealed, since the piston head and the piston skirt are connected only by way of the piston pin. The pistons of the stated type, known from WO 92/10658 A1 and from WO 10659 A1, solve the problem by means of a seal ring made of sheet metal, but this significantly reduces the volume of the cooling channel, so that the cooling effect is reduced. The piston known from WO 90/04094 A1 is provided with catch basins for the coolant, something that is complicated in design and does not improve the cooling effect.

The present invention is therefore based on the task of making available a piston that demonstrates an improved cooling effect while being simple to produce.

SUMMARY OF THE INVENTION

This task can be accomplished with a two-part piston for an internal combustion engine, comprising a piston head and a piston skirt connected with the piston head in articulated manner, by way of a piston pin. The piston head has a piston crown that is followed by a cylindrical circumference surface having a top land and a ring belt. The piston head can have a ring-shaped circumferential cooling channel, the opening of which, facing the piston skirt, is closed off with a seal element. This seal element has a first free end that is held between piston head and piston skirt, or rests against an outer wall of the cooling channel. In this case, the seal element has a second free end that rests against the piston head, and that the seal element has a bottom that lies on a surface of the piston skirt that faces the cooling channel.

This structure, according to the invention, makes it possible to effectively close off the cooling channel, without significantly reducing its volume. In this way, the cooling effect is not reduced by the seal element. Instead, the cooling effect of the coolant in the piston according to the invention can be effectively controlled and regulated due to the seal element. The coolant is not lost in an uncontrolled manner. As a result, the engine output is increased, since the ability of the piston according to the invention to withstand thermal and mechanical stress is improved, due to the more efficient cooling. Furthermore, because of the effective retention of the coolant, the emissions of an engine having a piston according to the invention are reduced. The seal element is simple and inexpensive to produce, and can be attached on the piston head of any desired articulated piston, without problems.

The piston can be particularly suitable for diesel engines, the pistons of which are subject to particularly great mechanical and thermal stresses.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DESCRIPTION OF THE PREFERRED EMBODIMENT

Figure 1:
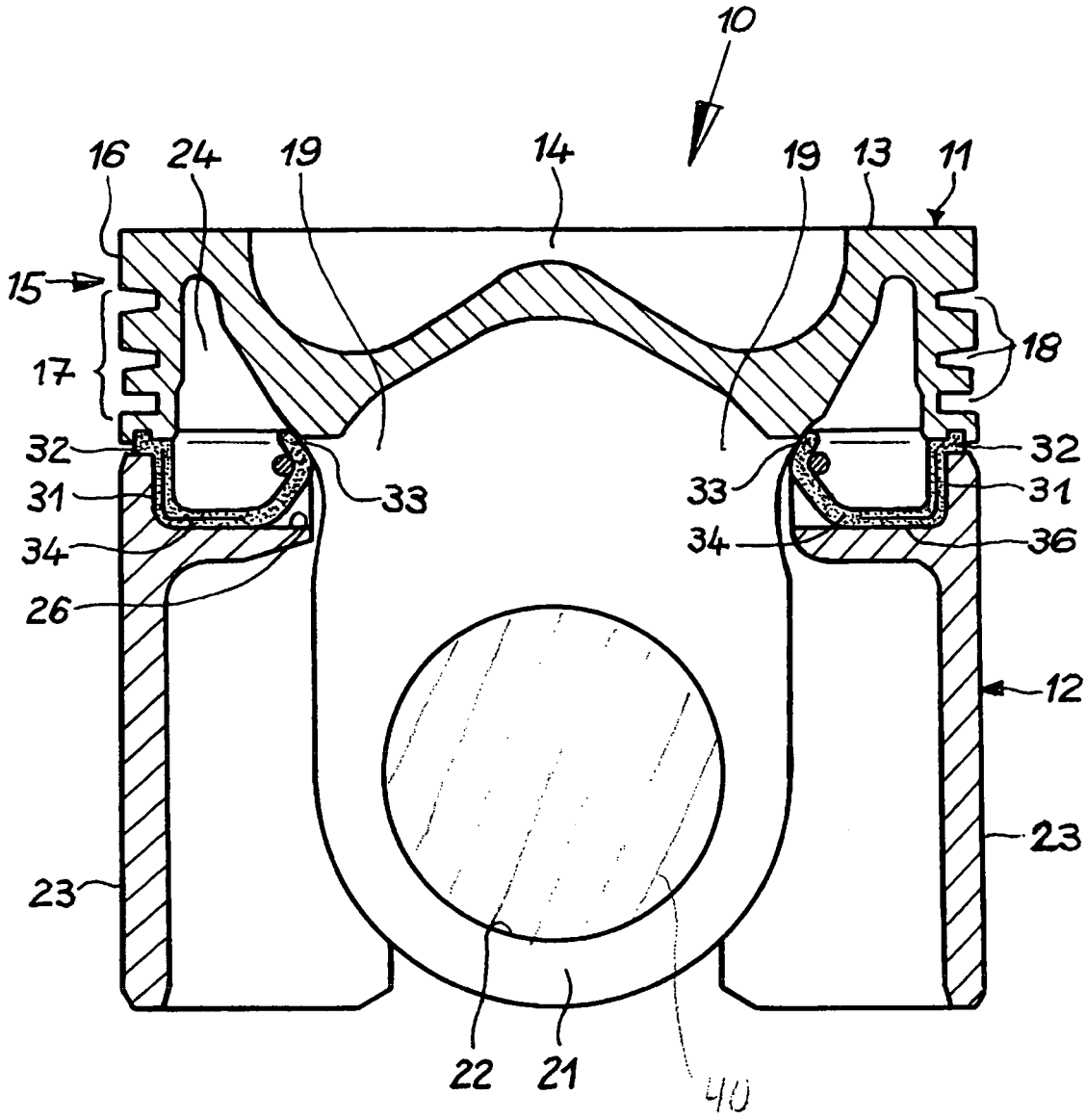
FIG. 1 shows an exemplary embodiment of a piston according to the invention in cross-section.
Figure 2:
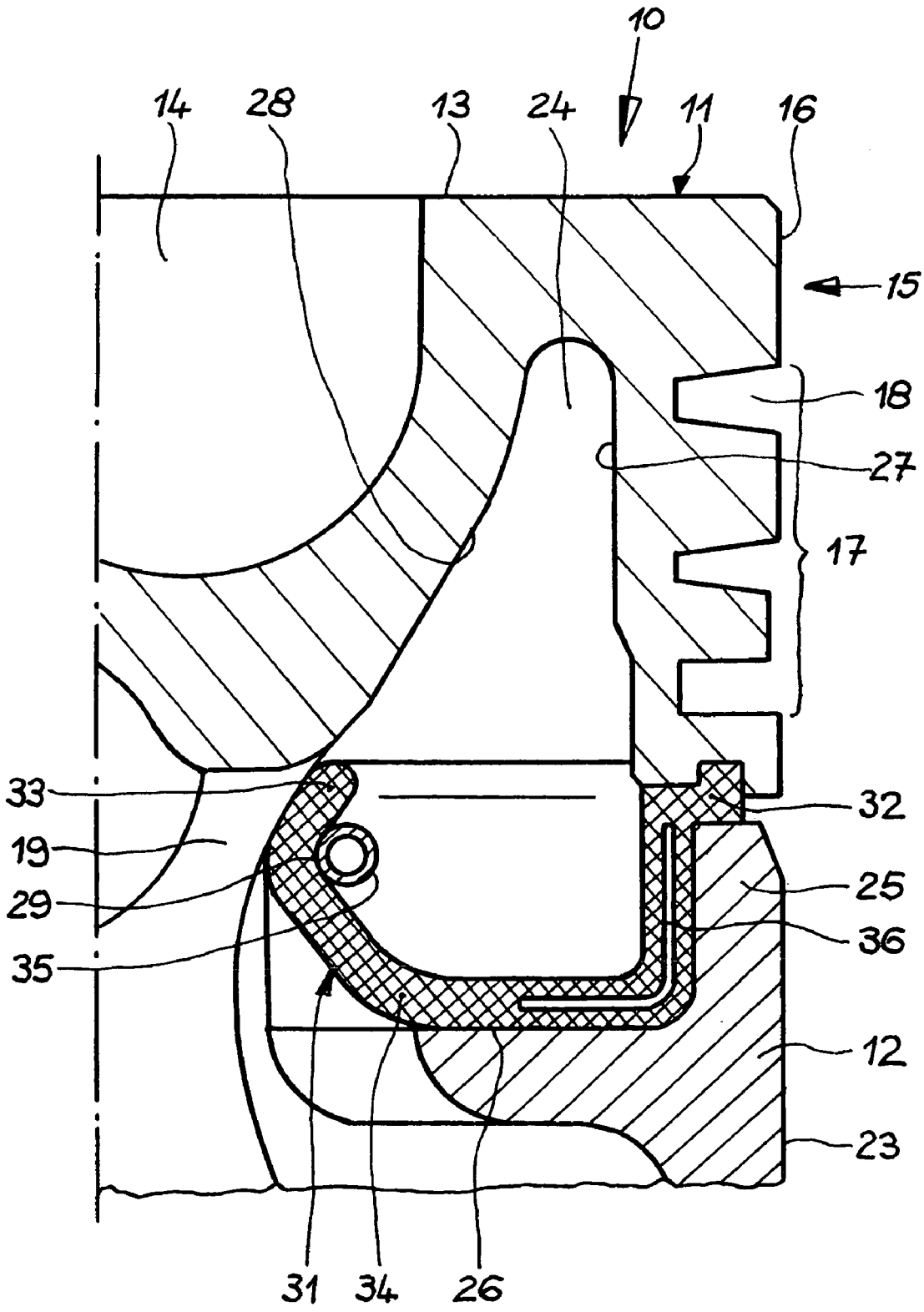
FIG. 2 shows a detail from FIG. 1, in an enlarged representation, in cross-section.

FIGS. 1 and 2 show an exemplary embodiment of a piston 10, having a piston head 11 and a piston shaft 12. Piston head 11 can be made from a metallic material, for example forged steel. Piston head 11 has a piston crown 13 that has a combustion bowl 14 in the exemplary embodiment. Piston crown 13 makes a transition into a cylindrical circumference surface 15 that includes a top land 16 and a ring belt 17. Ring belt 17 has ring grooves 18 for accommodating conventional piston rings (not shown). Piston skirt 12, which is partially cylindrical in the exemplary embodiment, includes a metallic material, for example an aluminum alloy. The piston skirt 12 has a working surface 23. Working surface 23 can be configured in cylinder shape and connected with two pin boss bodies having pin bores that align with one another, by way of connecting ridges (not shown). The working surface 23 of piston skirt 12 extends only over part of the total circumference of piston skirt 12, and has an interruption or recess, in each instance, in the region of the pin boss bodies, (not shown). Corresponding to the pin boss bodies of piston skirt 12, a pin boss ridge 19 is formed on the underside of piston crown 13 of piston head 11. This ridge 19 makes a transition into two pin boss bodies 21 having a pin bore 22. Pin bores 22 of piston head 11 are oriented in alignment with one another and also in alignment with the pin bores of piston skirt 12 in the assembled state of piston 10. A piston pin 40 which is shown in cross section, passes through all of the pin bores and connects the piston head 11 with the piston skirt 12.

This embodiment of an articulated piston corresponds, for example, to the piston available from Mahle GmbH, Stuttgart, Germany, which is available under the trade name "Ferrotherm-Kolben" ["ferrotherm piston"].

The piston head of piston 10 can also have a ring-shaped circumferential cooling channel 24. Cooling channel 24 runs coaxially to cylindrical circumference surface 15 of piston head 11, and is disposed approximately at the height of the ring belt 17. Cooling channel 24 is configured as a cavity that is open downward, i.e. towards the piston skirt 12. In addition, cooling channel 24 has an outer wall 27 that is adjacent to ring belt 17, and an inner wall 28 that is adjacent to combustion bowl 14. Piston skirt 12 has a surface 26 delimited by an outer circumferential edge 25 on its top that faces piston head 11, which surface delimits cooling channel 24, but does not close it off in sealing manner.

To close off cooling channel 24, there is a seal element 31, which is configured in a ring shape and circumferential, in the exemplary embodiment, i.e. as a seal ring. A one-piece seal element is particularly easy to produce and to attach to piston head 11. Seal element 31 has a first free end 32, configured as an outer circumferential edge in the exemplary embodiment, and a second free end 33, configured as an inner circumferential edge in the exemplary embodiment. First free end 32 and second free end 33 are connected with one another by means of a bottom 34, which lies on surface 26 of piston skirt 12 delimited by outer circumferential edge 25.

First free end 32 of seal element 31 is held and clamped between ring belt 17 of piston head 11 and edge 25 of piston skirt 12 in the manner of a labyrinth seal, in the exemplary embodiment. In this manner, cooling channel 24 is sealed towards the outside in a particularly effective manner, between piston head 11 and piston skirt 12. First free end 32 can, of course, be held between ring belt 17 and edge 25 in any other configuration and/or arrangement. However, first free end 32 can also rest against inner wall 27 of cooling channel 24, whereby the gap between edge 25 of piston skirt 12 and ring belt 17 of piston head 11 is covered, so that in this manner, as well, an effective seal of cooling channel 24 towards the outside takes place.

First free end 32 of seal element 31, i.e. the transition region to bottom 34 of seal element 31, rests against circumferential edge 25 of piston skirt 12 in the exemplary embodiment. Subsequent bottom 34 of seal element 31 lies on surface 26 delimited by circumferential edge 25, on top of piston skirt 12.

The transition region from bottom 34 to the second free end 33 of seal element 31 extends in the direction of pin boss ridge 19, so that second free end 33 of seal element 31 rests against pin boss ridge 19. The second free end 33 of seal element 31 can, of course, also extend along the inner wall 28 of cooling channel 24, and rest against it, if necessary. This configuration of seal element 31 has the effect that the volume of cooling channel 24 is not reduced, since it is continued to the top of piston skirt 12. Therefore, cooling channel 24 can accommodate sufficient coolant, so that the cooling function of cooling channel 24 is not impaired.

In the exemplary embodiment, second free end 33 of seal element 31 is held on the pin boss ridge of piston head 11 by means of a spring element 35, for example a spring washer. This results in reliably securing seal element 31 on piston head 11. Second free end 33 of seal element 31 is shaped radially to the outside in the exemplary embodiment, to form a circumferential depression 29, in which spring element 35 is securely held.

Seal element 31 should preferably consist of an elastic material. Then, spring element 35 can also be eliminated, if necessary, if seal element 31 rests on piston head 11, and on edge 25 of piston skirt 12, respectively, with sufficient reliability due to its elasticity. Seal element 31 can be configured as a resiliently elastic metal part, for example. However, seal element 31 preferably consists of an elastic plastic material, since it can then be produced and attached to piston head 11 in a particularly simple manner. Suitable materials are, for example, silicon rubbers, fluorine rubbers, for example the fluorine rubbers available from DuPont® Dow Elastomers L.L.C.®, USA, under the trade name "Viton,"®, as well as nitrile rubbers, for example HSN (Highly Saturated Nitrile Rubber) rubbers or HNBR (Hydrogenated Nitrile Rubber) rubbers, such as those that are available from Imperial Rubber & Urethane Corporation, USA,® or from Lanxess, Leverkusen, Germany, under the trade name "Therban."®. In this connection, attention must be paid only to the fact that the material of the seal element 31 is resistant to the coolant and to the temperature of the coolant (approximately 150° C. to 200° C.).

In this embodiment, seal element 31 additionally has a reinforcement element 36 in the form of a resiliently elastic metal strip that is embedded in seal element 31. The reinforcement element also acts to stabilize the shape of seal element 31 and thereby contributes to reliable functioning of seal element 31. In this embodiment, reinforcement element 36 extends only in the region of first free end 32, and partially in the region of bottom 34. However, a person skilled in the art is free to affix a reinforcement element of any desired material at any location on or inside seal element 31, in order to adapt seal element 31 to the requirements of an individual case.

Seal element 31 can be perforated at the bottom 34 to improve the contact with piston skirt 12 and, in particular, the heat removal to piston skirt 12, for example in the case of a seal element 31 made of a plastic that is a poor heat conductor.

Accordingly, while a few embodiments of the present invention have been shown and described, it is to be understood that many changes and modifications may be made thereunto without departing from the spirit and scope of the invention as defined in the appended claims.

The invention claimed is:

1. A two-part piston for an internal combustion engine, comprising:

a) a piston head having a ring shaped circumferential channel and comprising:

i) a piston crown; and ii) a cylindrical circumferential surface having a top land and a ring belt;

b) a piston skirt coupled to said piston head in an articulated manner;

c) a piston pin, for coupling said piston skirt to said piston head; and d) a seal element wherein said ring shaped circumferential channel has an opening of which, facing said piston skirt, is closed off with said seal element;

wherein said seal element has a first free end that is held between said piston head and said piston skirt, and wherein said seal element has a second free end that is held on said piston head by a spring element, and wherein said seal element has a bottom that lies on a surface of said piston skirt that faces said cooling channel.

2. The piston according to claim 1, wherein said seal element is configured in a ring shape which is circumferential, and wherein said first free end is configured as an outer circumferential edge, and wherein said second free end is configured as an inner circumferential edge.

3. The piston according to claim 1, wherein said spring element is configured as a spring washer.

4. The piston according to claim 1, wherein said seal element is elastic.

5. The piston according to claim 4, wherein said seal element is formed from a resiliently elastic metal part.

6. The piston according to claim 4, wherein said seal element is formed from an elastic plastic.

7. The piston according to claim 6, wherein said seal element is formed from at least one material selected from the group consisting of silicon rubber, fluorine rubber, and nitrile rubber.

8. The piston according to claim 1, wherein said bottom of said seal element is perforated.

9. A two-part piston for an internal combustion engine, comprising:

a) a piston head having a ring shaped circumferential channel and comprising:

i) a piston crown; and ii) a cylindrical circumferential surface having a top land and a ring belt;

b) a piston skirt coupled to said piston head in an articulated manner;

c) a piston pin, for coupling said piston skirt to said piston head; and d) a seal element wherein said ring shaped circumferential channel has an opening of which, facing said piston skirt, is closed off with said seal element;

wherein said seal element has a first free end that is held and clamped between said piston head and said piston skirt so as to form a labyrinth seal, and wherein said seal element has a second free end that rests against said piston head, and wherein said seal element has a bottom that lies on a surface of said piston skirt that faces said cooling channel.

10. A two-part piston for an internal combustion engine, comprising:

a) a piston head having a ring shaped circumferential channel and comprising:

i) a piston crown; and ii) a cylindrical circumferential surface having a top land and a ring belt;

b) a piston skirt coupled to said piston head in an articulated manner;

c) a piston pin, for coupling said piston skirt to said piston head; and d) a seal element reinforced by means of a reinforcement element, wherein said ring shaped circumferential channel has an opening of which, facing said piston skirt, is closed off with said seal element; wherein said seal element has a first free end that is held between said piston head and said piston skirt, and wherein said seal element has a second free end that rests against said piston head, and wherein said seal element has a bottom that lies on a surface of said piston skirt that faces said cooling channel.

11. The piston according to claim 10, wherein said reinforcement element is embedded in said seal element.

12. A two-part piston for an internal combustion engine, comprising:

a) a piston head having a ring shaped circumferential cooling channel comprising:

i) a piston crown; and ii) a cylindrical circumferential surface having a top land and a ring belt;

b) a piston skirt coupled to said piston head in articulated manner;

c) a piston pin, for coupling said piston skirt to said piston head; and d) a seal element;

wherein said ring shaped circumferential cooling channel has an outer wall and an inner wall, and at least one opening facing said piston skirt, which is closed off with said seal element, wherein said seal element has a first free end that rests against said outer wall of said cooling channel, and wherein said seal element has a second free end that rests against said piston head is held on the piston head and by a spring element, and wherein said seal element has a bottom that lies on a surface of said piston skirt that faces said cooling channel.

13. The piston according to claim 12, wherein said seal element is configured in a ring shape and is circumferential, and wherein said first free end is configured as an outer circumferential edge, and said second free end is configured as an inner circumferential edge.

14. The piston according to claim 12, wherein said spring element is configured as a spring washer.

15. The piston according to claim 12, wherein said seal element is elastic.

16. The piston according to claim 15, wherein said seal element is formed from a resiliently elastic metal part.

17. The piston according to claim 15, wherein said seal element is formed from an elastic plastic.

18. The piston according to claim 15, wherein said seal element is formed from a material selected from the group consisting of silicon rubber, fluorine rubber, and nitrile rubber.

19. The piston according to claim 12, wherein said seal element has a bottom that is perforated.

20. A two-part piston for an internal combustion engine, comprising:

a) a piston head having a ring shaped circumferential cooling channel comprising:

i) a piston crown; and ii) a cylindrical circumferential surface having a top land and a ring belt;

b) a piston skirt coupled to said piston head in articulated manner;

c) a piston pin, for coupling said piston skirt to said piston head; and d) a seal element reinforced by means of a reinforcement element;

wherein said ring shaped circumferential cooling channel has an outer wall and an inner wall, and at least one opening facing said piston skirt, which is closed off with said seal element, wherein said seal element has a first free end that rests against said outer wall of said cooling channel, and wherein said seal element has a second free end that rests against said piston head, and wherein said seal element has a bottom that lies on a surface of said piston skirt that faces said cooling channel.

21. The piston according to claim 20, wherein said reinforcement element is embedded in said seal element.

* * * * *